US005314715A

United States Patent [19]

Arfsten et al.

[11] Patent Number: 5,314,715

[45] Date of Patent: May 24, 1994

[54] COATING PROCESS

[75] Inventors: Nanning Arfsten, Ockenheim; Hermann Piehlke, Nackenheim; Reinhard Kaufmann, Mainz, all of Fed. Rep. of Germany

[73] Assignee: Schott Glaswerke, Mainz, Fed. Rep. of Germany

[21] Appl. No.: 17,189

[22] Filed: Feb. 12, 1993

[30] Foreign Application Priority Data

Feb. 15, 1992 [DE] Fed. Rep. of Germany ..... 4204637

[51] Int. Cl.[5] ..... B05D 3/12

[52] U.S. Cl. ..... 427/240; 427/72

[58] Field of Search ..... 427/240, 72

[56] References Cited

U.S. PATENT DOCUMENTS

| | | | |
|---|---|---|---|
| 3,824,955 | 7/1974 | Marks et al. | 118/500 |
| 4,908,232 | 3/1990 | Itou et al. | 427/240 |
| 5,013,586 | 5/1981 | Cavazza | 427/240 |

FOREIGN PATENT DOCUMENTS

| | | | |
|---|---|---|---|
| 0286129 | 10/1988 | European Pat. Off. . | |
| 3-152827(A) | 6/1981 | Japan . | |
| 63-98933 | 4/1988 | Japan | 427/72 |
| 1-204330(A) | 8/1989 | Japan . | |
| 2-12736(A) | 1/1990 | Japan . | |
| 2-94335(A) | 5/1990 | Japan . | |
| 2-195629(A) | 8/1990 | Japan . | |
| 2-242547(A) | 9/1990 | Japan . | |
| 3-176933(A) | 7/1991 | Japan . | |

OTHER PUBLICATIONS

Patent Abstracts of Japan, vol. 9, No. 258 (E-350) (1981) Oct. 16, 1985.

*Primary Examiner*—Janyce Bell

*Attorney, Agent, or Firm*—Millen, White, Zelano & Branigan

[57] ABSTRACT

A process for centrifugal coating of large-surface, arched elements, especially of cathode-ray-tube displays or screens, in which during the centrifugal coating, a disk matched to approximately the shape of the surface to be coated is rotated at a distance of 1 to 10 mm above the surface to be coated at approximately the centrifugal speed equidirectional with the surface to be coated.

13 Claims, 1 Drawing Sheet

COATING PROCESS

BACKGROUND OF THE INVENTION

1. Field of the Invention

Process for producing thin layers of large-surface, arched elements, especially cathode-ray-tube displays, by centrifugal coating.

2. Background Art

Usually, the outside surface of the display of a picture tube is highly polished and has very high electrical resistance. The bright, smooth surface causes often disturbing reflections, and the high electrical resistance results in an electrostatic charging of the display surface during the operation of the tube. To avoid these drawbacks, it is known to equip the surface of the display antistatically or antireflectively by applying one or more thin layers, for which numerous methods are known. It is common to apply, e.g., on the display surface, an alcoholic solution of silicon-organic compounds, especially silicon alcoholates, optionally together with titanium-organic compounds to match the index of refraction, in a thin layer which, after drying and baking, form an $SiO_2$ film, which exhibits antistatic and antireflective properties. Once in a while, several layers, optionally with different indicates of refraction, are also applied after respective intermediate drying and then baked on together. Quite excellent antireflective effects can be produced especially with several layers.

In the design of the layers, it is especially important that the latter exhibit a uniform thickness over the entire surface of the object to be coated. As a coating process for producing thin layers of large-surface, arched elements, especially the centrifugal coating is used. In this process, the coating solution is fed to the object to be coated, distributed by rotation of the object to be coated and any possible excess is centrifuged off at the borders. The centrifuging process is a simple process and also works very quickly, but different layer thicknesses can occur especially in the outside and corner areas of large-surface displays, which can cause undesirable effects, e.g., interference.

To produce a uniform layer thickness, it is known, e.g., from EP 286 129 A, to place the display surface to be coated pointing downward in an obliquely arranged drum, which has an upward opening. The display surface is then sprayed while rotating with the coating solution. During the rotation, the display surface is direct with a hot-air blower with a part of the formed liquid film in and around the center of the display by targeted blowing with hot air. Such a process is comparatively expensive. From JP 2-12736 A, a process is known in which the display to be coated is used with the surface to be coated pointing upward into a trough whose holding plates for the display are configured so that they form practically a continuation of the display surface. Further, it is described in this patent specification to provide two diagonally placed, very high bars running up to approximately the center, which rotate synchronously with the picture tube during the coating. By these arrangements, a uniform layer thickness of the applied layer is to be achieved. But these processes do not always work satisfactorily, especially in the case of large display surfaces.

SUMMARY OF THE INVENTION

The object of the invention is to provide a process for centrifugal coating with very homogeneous coatings, in which only a comparatively small amount of equipment is necessary and in which the consumption of coating material is minimized even with large-surface elements.

The production of an especially uniform layer thickness over the entire surface to be coated is achieved in that during the centrifuging process at a distance of 1–10 mm above the surface to be coated, a disk or shield matched to approximately the shape of the surface to be coated. If the distance from the disk to the surface to be coated becomes smaller than 1 mm, the expense with respect to the equipment greatly increases because of the then necessary high precision. Moreover, breakdowns can occur in rough everyday operation. If the distance of the rotating disk from the surface to be coated is greater than 10 mm, unevenness in the layer thickness could occur, especially in large parts to be coated. A distance for the disk of 2–4 mm is preferred. Further, it is preferred when the rotating disk follows the contour of the border on the borders of the surface to be coated, i.e., the distance is decreased to a depth of about 0.5–2 cm at a lateral distance of 1 to 10 mm from the edges of the object to be coated.

The addition of the coating solution takes place most advantageously during the rotation by a central opening in the disk rotating concentrically with respect to the surface to be coated. An additional advantage is that during the rotation little coating solution is consumed. The size of the central opening is largely uncritical, but in practice, it is preferred not to allow the diameter of this opening to become greater than 15 cm, preferably not greater than 3 cm. The smallest diameter of the feed opening is limited by the necessity to allow the coating compound or a connection pipe feeding the coating compound to pass through. Of course, it is also possible to close the opening after feeding the coating solution.

The connection pipe can also be connected securely with the disk and be connected by a rotating seal to a feeding system for the coating solution. The distance of the disk from the surface to be coated is to be 1–10 mm, preferably 2–4 mm, by which a disk shape matched to approximately the shape of the surface to be coated is achieved. It is further preferred if at a given average distance of the disk to the stressed area, the difference of the distance of the disk between the smallest and largest distance from the surface to be coated is at most 4 mm. Further, it is preferred that the distance of the disk to the surface to be coated in the outside third of the border area is between 1 and 4 mm, preferably 2 and 3 mm.

The speeds at which disk and surface to be coated rotate during the centrifugal coating are known in the art and extend from less than 300 rpm up to about 1,500 rpm. About 500–700 rpm is preferred. The speed of the rotating disk should not substantially deviate from the speed at which the surface to be coated rotates. It is preferred if the rotating disk and the surface to be coated run at the same speed, which is also the solution that can be most simply implemented with respect to the equipment. But it is also quite possible to allow speed differences of up to about 10%.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
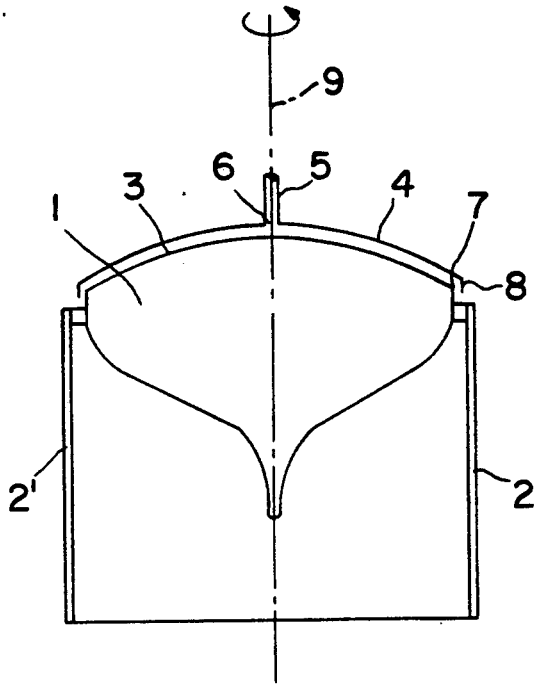
FIG. 1 is in a diagrammatical way, a section through a clamped picture tube with a rotating disk placed above it.
Figure 2:
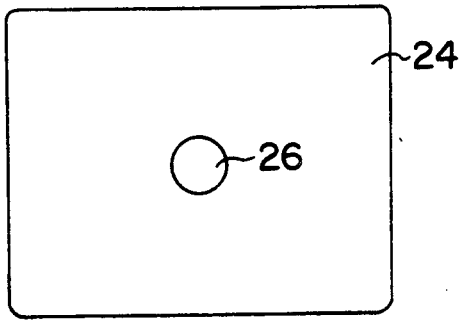
FIG. 2 is a top view of a rotating disk with a central opening.

FIG. 1 shows a cathode ray picture tube 1, which is held by a holding device 2 and 2'. Display side 3 to be coated points upward. Disk or shield 4, which basically corresponds in shape to the surface to be coated, is placed at a small distance above the surface to be coated. For centrifugal coating, picture tube 1 can rotate with holding device 2 and 2' as well as disk or shield 4 preferably synchronously around axis 9 and feeds the coating solution on surface 3 through central opening 6. A completely uniform coating film forms up to the border areas of surface 3 to be coated. The operating mechanisms for picture tube 1 clamped in holding device 2 and 2' as well as for disk 4 are not specially represented. Instead of by connection pipe 5, the disk can, of course, also be attached to holding devices 2 and 2' in a suitable way and also operated from there. FIG. 2 shows a top view of a disk 24 with a centrally placed feed opening 26 to apply the coating solution.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the foregoing and in the following example, all temperatures are set forth uncorrected in degrees Celsius and unless otherwise indicated, all parts and percentages are by weight.

The entire disclosures of all applications, patents and publications, cited above and below, and of corresponding application German No. P 42 04 637.8, filed Feb. 15, 1992, are hereby incorporated by reference.

EXAMPLE

A cathode ray picture tube with the dimensions $25\times32$ cm$^2$ is clamped in a device similar to FIG. 1. A disk, which is provided with a collar and as a result is pulled 0.5 cm around the edge of the surface to be coated, is placed at a distance of 2 mm from the surface to be coated. The disk is provided with a central opening of a 0.2–1 cm diameter for feeding the coating compound. The axes of rotation of display 1 and disk 4 are, of course, concentric. Disk and display now are put in rotation equidirectionally with 800 rpm and 5 ml of coating solution added all at once through the central opening. The coating solution has the following composition: 32 g of $(OCH_3)_4Si(OCH_3)_4$, 88 ml of ethanol, 1 ml of HCl and 27 ml of $H_2O$.

After the addition of the coating solution, disk and display can rotate for about 10 more seconds, the display is removed from the holding device, dried at 150° C. and then the coating is baked on at 400°–450° C. The layer produced on the display surface had a thickness of 91 nm$\pm$2 nm over the entire surface. The drying of the coating solution on the display surface can also take place when the picture tube is still clamped in the holding device, by, e.g., the disk being tilted away and warm or hot air being blown at the entire disk surface. The display can rotate or stand still here. After the drying of the first layer, corresponding other layers can be applied, so that a layer package is obtained, which then is baked on together in a firing process. In this way, excellent antireflective coating or antistatic equipment can be achieved.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for coating material on large-surface, arched objects by centrifugal coating, wherein during the centrifuging process, a disk matched to approximately the shape of the surface to be coated rotates with the arched objects at a distance of 1 to 10 mm above the surface to be coated at approximately the centrifugal speed equidirectional with the surface to be coated as the coating solution is applied.

2. A process according to claim 1, wherein the disk is rotated at a distance of 2 to 4 mm above the surface to be coated.

3. A process according to claim 2, wherein a disk is rotated which is pulled down about 0.5 to 2 cm deep at a distance of 1 to 10 mm around the edges of the surface to be coated.

4. A process according to claim 3, wherein the coating solution is added during the rotation through a central opening in the disk, which is not greater than 15 cm.

5. A process according to claim 4, wherein the centrifuging process is performed at 300 to 1500 rpm.

6. A process according to claim 1, wherein a disk is rotated which is pulled down about 0.5 to 2 cm deep at a distance of 1 to 10 mm around the edges of the surface to be coated.

7. A process according to claim 1, wherein the coating solution is added during the rotation through a central opening in the disk, which is not greater than 15 cm.

8. A process according to claim 1, wherein the centrifuging process is performed at 300 to 1500 rpm.

9. A process for coating an arched surface of an object with a material comprising the steps of:

retaining the object with a retainer;

covering the arched surface with a shield spaced about 1 to 10 mm above the arched surface;

rotating the retainer shield and object together while dispensing the coating solution through the opening into the space between the shield and the arched surface to centrifugally coat the arched surface with the solution.

10. The process of claim 9, wherein the object is a cathode ray tube and wherein the arched surface is the display surface thereof.

11. The process of claim 10, wherein the coating solution is comprised of $(OCH_3)_4Si(OCH_3)_4$, ethanol, HCl and $H_2O$.

12. The process of claim 11, wherein the retainer shield and object are rotated at a speed of about 800 rpm.

13. The process of claim 12, wherein the shield has a depending collar extending over the periphery of the display surface and spaced from the periphery of the display surface by a distance of about 0.5 cm.

* * * * *